US005975198A

United States Patent [19]

Kim et al.

[11] Patent Number: 5,975,198

[45] Date of Patent: Nov. 2, 1999

[54] AIR CONDITIONER HEAT-EXCHANGER

[75] Inventors: Young-Saeng Kim, Incheon; Baek Youn, Suwon, both of Rep. of Korea

[73] Assignee: Samsung Electronics Co., Ltd., Suwon, Rep. of Korea

[21] Appl. No.: 08/976,724

[22] Filed: Nov. 24, 1997

[30] Foreign Application Priority Data

May 31, 1997 [KR] Rep. of Korea ..... 97-22534

[51] Int. Cl.[6] ..... F28D 1/04

[52] U.S. Cl. ..... 165/151; 165/DIG. 910; 165/DIG. 501

[58] Field of Search ..... 165/151, DIG. 910, 165/DIG. 501

[56] References Cited

U.S. PATENT DOCUMENTS

| | | | |
|---|---|---|---|
| 817,692 | 4/1906 | Briscoe | 165/DIG. 501 |
| 4,995,453 | 2/1991 | Bartlett | 165/151 |
| 5,076,353 | 12/1991 | Haussmann | 165/151 |
| 5,111,876 | 5/1992 | Nash | 165/151 |
| 5,222,550 | 6/1993 | Griffin et al. | 165/151 |

FOREIGN PATENT DOCUMENTS

| | | | |
|---|---|---|---|
| 60-33495 | 2/1985 | Japan | 165/151 |
| 61-243292 | 10/1986 | Japan | 165/151 |
| 61-27294 | 12/1986 | Japan | 165/151 |
| 62-190393 | 8/1987 | Japan | 165/151 |
| 63-3185 | 1/1988 | Japan | 165/151 |
| 63-3186 | 1/1988 | Japan | 165/151 |
| 63-3188 | 1/1988 | Japan | 165/151 |
| 63-3189 | 1/1988 | Japan | 165/151 |
| 63-41790 | 2/1988 | Japan | 165/151 |
| 63-101698 | 5/1988 | Japan | 165/151 |
| 1-212895 | 8/1989 | Japan | 165/151 |
| 2-171597 | 7/1990 | Japan | 165/151 |
| 3841-180 | 4/1990 | United Kingdom | 165/910 |

*Primary Examiner*—Ira S. Lazarus
*Assistant Examiner*—Terrell McKinnon
*Attorney, Agent, or Firm*—Burns, Doane, Swecker & Mathis, L.L.P.

[57] ABSTRACT

An air conditioner heat-exchanger is provided to smoothen the air flowing through a plurality of the heat transfer tubes, thereby improving heat transference efficiency and heat-exchange effect, the air conditioner heat-exchanger having a plurality of flat fins arranged in parallel at a predetermined interval and a plurality of heat transfer tubes perpendicularly inserted to the plurality of flat fins, the plurality of heat transfer tubes being arranged against the air flowing direction (S) with a predetermined horizontal interval (X) and a predetermined vertical interval (Y) maintained therebetween to avoid the influence of the dead air region (P) formed therebehind.

2 Claims, 2 Drawing Sheets

AIR CONDITIONER HEAT-EXCHANGER

BACKGROUND OF THE INVENTION

1. Field of the Invention

The present invention relates to an air conditioner heat-exchanger and more particularly to an air conditioner heat-exchanger which has an arrangement of a plurality of heat transfer tubes on flat fins.

2. Description of the Prior Art

A conventional air conditioner in accordance with a first embodiment, as illustrated in FIG. 1, includes a plurality of flat fins(100) arranged in parallel at a predetermined interval allowing air to flow therebetween for heat transference and a plurality of heat transfer tubes(200) perpendicularly inserted to the plurality of flat fins(100) to which the temperature of a coolant is transferred while being flown inwards, and at the same time, being contacted to air for heat-exchange. At this time, the plurality of the heat transfer tubes(200) are vertically (A), horizontally (B) and continuously arranged at a predetermined interval toward the air flowing direction (shown as an arrow).

In addition, a conventional air conditioner in accordance with another embodiment, as shown in FIG. 2, a plurality of flat fins(100) are arranged in parallel at a predetermined interval allowing air to flow therebetween for heat transference and a plurality of heat transfer tubes(200) perpendicularly inserted to the plurality of flat fins(100) to which the temperature of a coolant is transferred while being flown inwards, at the same time, being contacted to air for heat-exchange.

At this time, the plurality of heat transfer tubes(200) are vertically arranged in a series at a predetermined interval while being horizontally arranged in a continuous zigzag manner. Here, for the easy explanation, the plurality of the heat transfer tubes(200) are numbered, where 201 is given specifically for those aligned vertically at a first column at the left end of the flat fins(100), 202 for those aligned at a second column at the center of the flat fins(100), and 203 for those aligned at a third column at the right end of the flat fins(100).

Accordingly, the heat transfer tubes(201) at the first column and those(203) at the third column are horizontally at an equal height. However, the heat transfer tubes(202) at the center column are positioned between those(201) at the first column and those(203) at the third column leaving a predetermined base height which results in a different height arrangement from those at the first and third columns. An unexplained character, P, is for a dead air region.

As the air conditioner is operated, the conventional air conditioner heat-exchangers carry out heat-exchange in a cooling cycle of a coolant (not shown) where the coolant is infused and circulated at the heat transfer tubes(200), thereby being heat-exchanged by the air flowing along the arrow direction. At this time, if a slit type of pattern (not shown), a louver type of pattern (not shown) or the like is placed on the plurality of flat fins(100), the air flow is mixed and changed into turbulent air flow to permit the dead air region (P) to be reduced, thereby promoting the heat-exchange effect.

However, there is a problem in the first embodiment of conventional air conditioner heat-exchanger in that the heat exchange effect is substantially deteriorated due to the influence of the dead air region as the heat transfer tubes (200) are arranged in the identical direction with that of the air flow, as shown in FIG. 1.

Furthermore, there is another problem in another embodiment of the conventional air conditioner heat-exchanger in that even if the heat-exchange effect is promoted as the heat transfer tubes(202) at the second column are arranged at a different height from those at the first column excluding the influence of the dead air region formed by the heat transfer tubes(201) at the first column, the air flow is particularly reduced and the heat-exchange effect is substantially deteriorated as the third heat transfer tubes(203) are arranged at the identical height to those(201) at the first column in parallel, thereby being influenced by the dead air region (P) thereof.

SUMMARY OF THE INVENTION

The present invention is presented to solve the aforementioned problems and it is an object of the present invention to provide an air conditioner heat-exchanger which substantially improves heat-exchange effect as its heat transfer tubes at first, second, third columns are arranged in their different horizontal heights.

In order to achieve the object of the present invention, there is provided an air conditioner heat-exchanger having a plurality of flat fins(100) arranged in parallel at a predetermined interval and a plurality of heat transfer tubes(200) perpendicularly inserted to the plurality of flat fins(100), the plurality of heat transfer tubes being arranged against the air flowing direction (S) with a predetermined horizontal interval (X) and a predetermined vertical interval (Y) being maintained therebetween to avoid the influence of the dead air region (P) formed therebehind.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Figure 1:
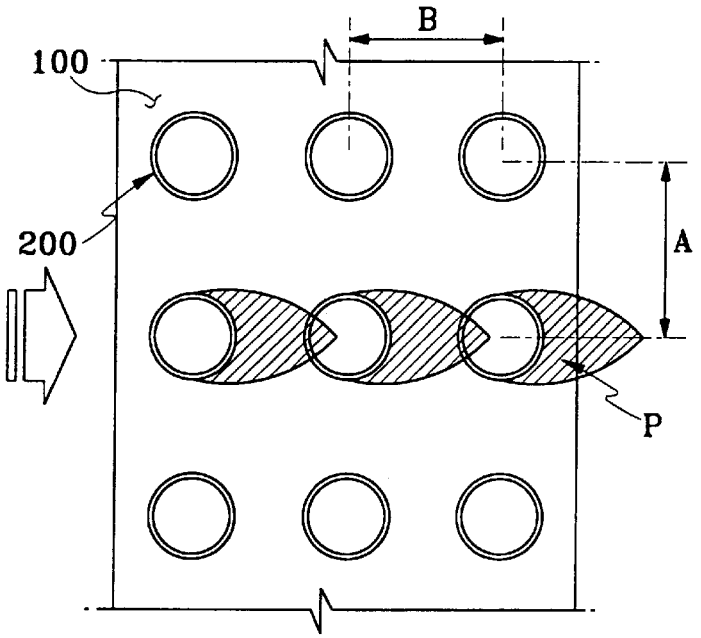
FIG. 1 (Prior Art)
FIG. 1 is a brief diagram for illustrating an air conditioner heat-exchanger in accordance with an embodiment of the prior art.
Figure 2:
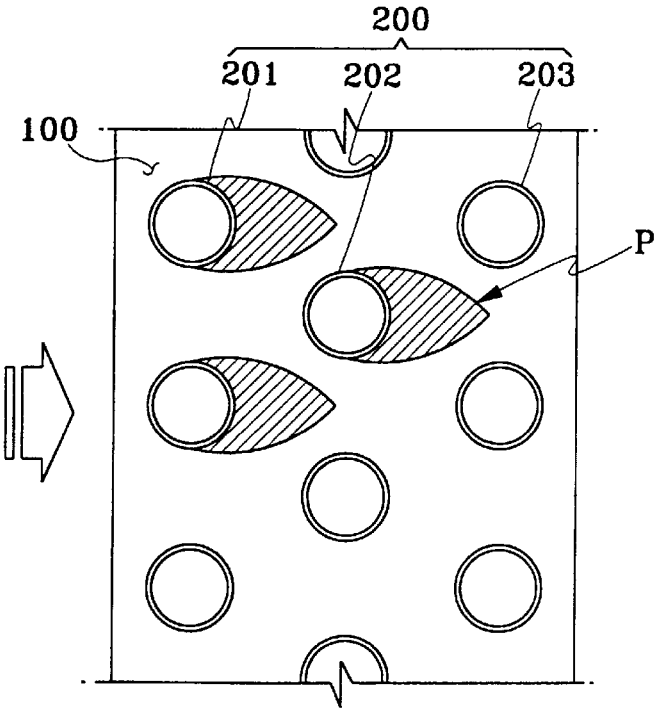
FIG. 2 (Prior Art)
FIG. 2 is a brief diagram for illustrating an air conditioner heat-exchanger in accordance with another embodiment of the prior art.

An embodiment of the present invention is described in detail with reference to the accompanying drawing of FIG. 2. Throughout the drawing, like reference numerals and symbols are used for designation of like or equivalent parts or portions for simplicity of illustration and explanation, and redundant references will be omitted.

Figure 3:
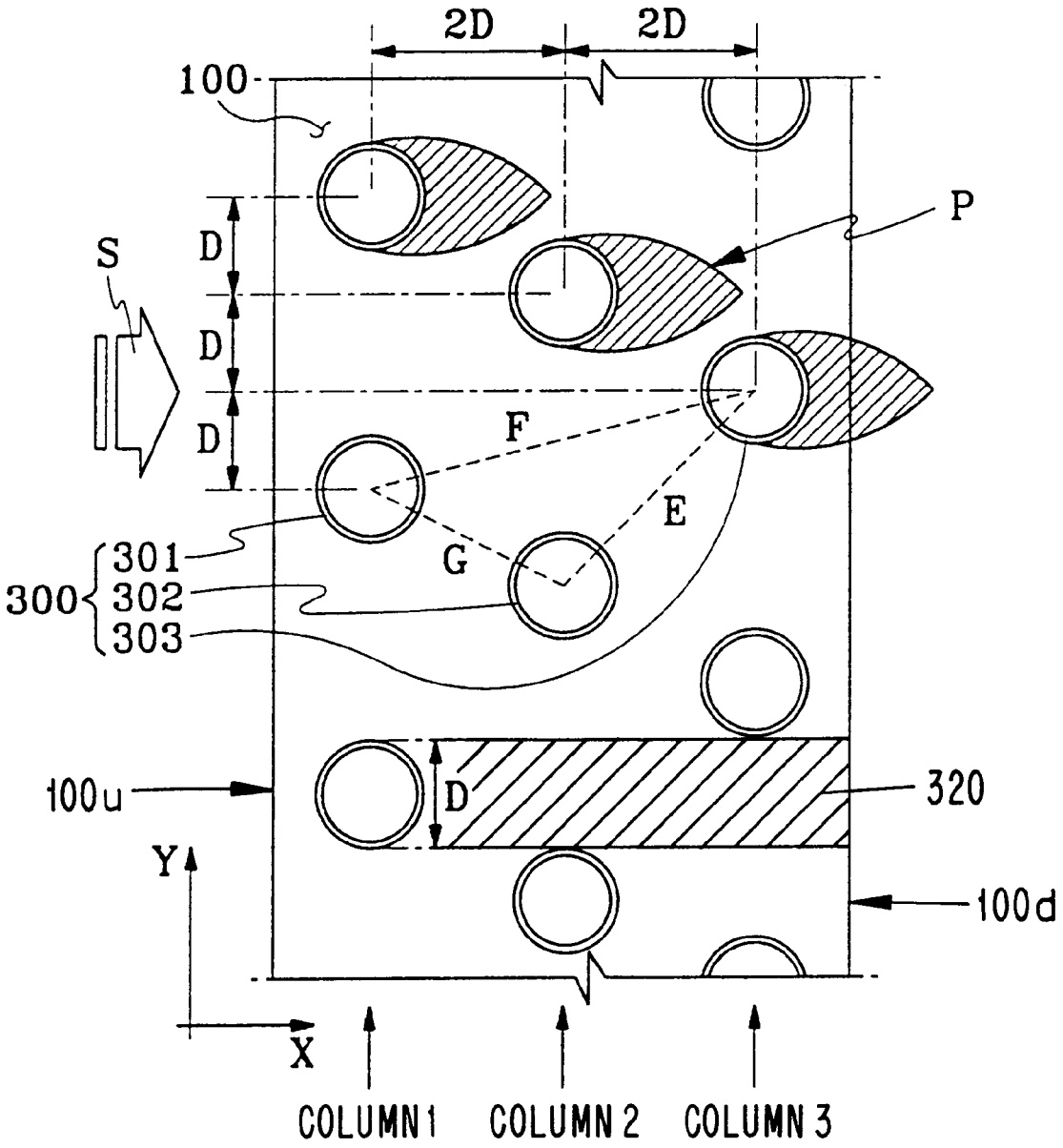
FIG. 3 is a brief diagram for illustrating an air conditioner heat-exchanger in accordance with an embodiment of the present invention.

As shown in FIG. 3, an air conditioner heat-exchanger comprises a flat fins(100) arranged in parallel at a predetermined interval in a horizontal first direction and a plurality of heat transfer tubes(300) perpendicularly inserted to the plurality of flat fins(100) to which the temperature of a coolant is transferred while being conducted inwards, at the same time, being contacted to air for heat-exchange. Each fin (100) has upstream and downstream ends 100*u*, 100*d* spaced apart in a second direction X oriented perpendicular to the first direction. The plurality of heat transfer tubes(300) are arranged against the air flowing direction (S) with a predetermined horizontal interval (i.e., in the second direction X) and a predetermined vertical interval (i.e., in a third direction Y oriented perpendicular to the first and second directions) being maintained therebetween to avoid the influence of the dead air region (P) formed behind themselves.

Here, a plurality of heat transfer tubes(300), if the outer diameter of the heat transfer tube is D, are respectively, each being arranged at a different vertical interval (Y) as $3D<Y<(3D+\alpha)$ while each being arranged at a different horizontal interval (X) as $1D<X<(1D+\alpha)$.

For easy explanation, if the interval between a plurality of heat transfer tubes(302) arranged at the second column and those(303) at the third column is E, if the interval between a plurality of heat transfer tubes(301) arranged at the first column and those(303) at the third column is F, and if the interval between a plurality of heat transfer tubes(301) arranged at the first column and those at the second column (302) is G, a triangular shape of 3 different lengths sides are expressed in order of $F>E>G$.

At this time, if the diameter of the heat transfer tube is D, the interval (E) is in the range of $3D<E<(3D+\alpha)$, the interval (F) is in the range of $4D<F<(4D+\alpha)$, and the interval (G) is in the range of $2D<G<(2D+\alpha)$.

It will be appreciated that an area (320) having a width D extends from the downstream half of each tube (300) to the downstream edge (100*d*) of the fin (100) without intersecting another of the tubes. That occurs because each tube is spaced from every other tube in the third direction Y by a distance at least equal to the tube outer diameter D.

Next, the operational effect is described below. If the air conditioner is operated, the coolant is infused into the heat transfer tubes(300) by way of a coolant circulation and, then, heat-exchanged by the air flowing in the air flow direction (S) while the coolant is circulated into the heat transfer tubes(300).

The air flows on both surfaces of the plurality of the flat fins(100) and between the plurality of the heat transfer tubes(300) and changed into turbulent air, thereby reducing the dead air region (P) formed behind the heat transfer tubes(300) to promote the heat-exchange effect.

The plurality of the heat transfer tubes(300) are horizontally arranged to avoid any conflict of air flow among the heat transfer tubes(301) at the first column, those(302) at the second column and those(303) at the third column. Therefore, the heat transfer tubes(302) at the second column and those(303) at the third column are not included in the dead air region (P) formed behind the heat transfer tubes (301) at the first column. In addition, the heat transfer tubes(303) at the third column are not included in the dead air region (P) formed behind the heat transfer tubes(302) at the second column.

As the plurality of the heat transfer tubes(300) are not influenced by the dead air region formed behind themselves, which facilitates the smooth air flow, thereby improving the heat transfer efficiency and heat-change effect.

The air conditioner heat-exchanger of the present invention has a structure in which the heat transfer tubes are horizontally and vertically arranged at a predetermined interval on the flat fins, which prevents the heat transfer tubes at the second and third columns from being influenced by the dead air region formed behind the heat transfer tubes at the first column in the horizontal direction and which avoids the influence of the dead air region at the second column upon the heat transfer tubes at the third column, so as that the air flowing through the plurality of the heat transfer tubes is smoothened, thereby improving heat transference efficiency and heat-exchange effect.

What is claimed is:

1. An air conditioner heat exchanger comprising a plurality of flat fins arranged parallel to one another and spaced from one another in a first direction to accommodate an air flow therebetween, each fin including upstream and downstream edges spaced apart in a second direction oriented perpendicular to the first direction and corresponding to an air flow direction, and a plurality of heat transfer tubes extending perpendicularly through the plurality of fins in the first direction, each tube having an outer diameter D and arranged such that a downstream half of each tube faces the downstream edge of the fin, the tubes arranged in columns extending in a third direction, oriented perpendicularly to both of the first and second directions, there being more than two columns, and the columns being spaced apart in the second direction, each of the tubes in the heat exchanger being spaced from every other tube thereof in the third direction by a distance equal at least to the outer diameter D, whereby an area having a width equal to D in the third direction extends from the downstream half of each tube to the downstream edge of the fin without intersecting another of the tubes.

2. The heat exchanger according to claim 1 wherein the first and second directions are horizontal, and the third direction is vertical.

* * * * *